US011236866B2

(12) United States Patent
Chiang

(10) Patent No.: US 11,236,866 B2
(45) Date of Patent: Feb. 1, 2022

(54) LIQUID TRANSFER APPARATUS

(71) Applicant: Te-Ming Chiang, Hsinchu (TW)

(72) Inventor: Te-Ming Chiang, Hsinchu (TW)

( * ) Notice: Subject to any disclaimer, the term of this patent is extended or adjusted under 35 U.S.C. 154(b) by 0 days.

(21) Appl. No.: 17/171,405

(22) Filed: Feb. 9, 2021

(65) Prior Publication Data

US 2021/0164620 A1 Jun. 3, 2021

Related U.S. Application Data

(63) Continuation-in-part of application No. 16/253,377, filed on Jan. 22, 2019, now abandoned.

(30) Foreign Application Priority Data

Sep. 3, 2018 (TW) ..... 107130805

(51) Int. Cl.

| | |
|---|---|
| ***F17D 1/12*** | (2006.01) |
| ***F04F 10/00*** | (2006.01) |
| ***F17D 1/20*** | (2006.01) |
| ***F17D 3/01*** | (2006.01) |

(Continued)

(52) U.S. Cl.

CPC ..... *F17D 1/12* (2013.01); *F04F 10/00* (2013.01); *F17D 1/20* (2013.01); *F17D 3/01* (2013.01); *F17D 3/10* (2013.01); *B67D 7/00* (2013.01)

(58) Field of Classification Search

CPC ..... F17D 1/12; F17D 1/20; F17D 3/10; F17D 3/01; F04F 10/00; B67D 7/00

See application file for complete search history.

(56) References Cited

U.S. PATENT DOCUMENTS 3,883,269 A * 5/1975 Wolff ..... B65G 53/30 417/122

4,150,700 A ‡ 4/1979 Fox, Jr. ..... B67D 7/00 134/166 C (Continued)

OTHER PUBLICATIONS

Non-Final Office Action dated Apr. 17, 2020 for U.S. Appl. No. 16/253,377.

(Continued)

*Primary Examiner* — Daphne M Barry
*Assistant Examiner* — Patrick C Williams
(74) *Attorney, Agent, or Firm* — Schmeiser, Olsen & Watts, LLP

(57) ABSTRACT

A liquid transfer apparatus comprises an output terminal device, a receiving terminal device, a connecting pipeline, and a control device. The output terminal device includes a first pressurizing member for filling the first storage container with high-pressure air. The receiving terminal device includes an air pressure adjusting member for adjusting the air pressure inside the second storage container. When the liquid transfer apparatus is in a non-transferring state, the air pressure inside the second storage container is high enough to prevent the liquid in the first storage container flow into the connecting pipeline. And when the liquid transfer apparatus is in a transferring state, the pressure difference between the inside of the first storage container and the inside of the second storage container is sufficient to drive the liquid in the first storage container to enter the second storage container.

11 Claims, 8 Drawing Sheets

(51) Int. Cl.
*F17D 3/10* (2006.01)
*B67D 7/00* (2010.01)

(56) References Cited

U.S. PATENT DOCUMENTS 4,323,452 A * 4/1982 Witzenburg ..... F17D 1/12 210/188
4,408,960 A * 10/1983 Allen ..... F04F 1/10 417/125
5,148,945 A ‡ 9/1992 Geatz ..... B01F 15/00422 222/1
5,507,601 A * 4/1996 Taguchi ..... B67D 7/0238 406/120
6,116,260 A ‡ 9/2000 Nakagawa ..... B01J 4/00 137/14
6,772,803 B2 * 8/2004 Awad ..... F04F 1/02 141/59
6,840,252 B2 ‡ 1/2005 Zorich ..... B08B 9/032 134/95.1
2013/0111807 A1 ‡ 5/2013 Bathurst ..... F17D 1/20 44/457
2013/0228227 A1 * 9/2013 Kempson ..... F04F 10/00 137/2
2014/0076901 A1 * 3/2014 Manahan ..... B65D 43/26 220/324
2015/0052877 A1 * 2/2015 Leone ..... F17D 3/01 60/273
2017/0187051 A1 * 6/2017 Xiang ..... F17C 5/06
2017/0299123 A1 ‡ 10/2017 Fowler ..... F04D 15/0027
2017/0328651 A1 ‡ 11/2017 Rozga ..... H05B 3/42

OTHER PUBLICATIONS

Final Office Action dated Oct. 19, 2020 for U.S. Appl. No. 16/253,377.

* cited by examiner
‡ imported from a related application

LIQUID TRANSFER APPARATUS

CROSS-REFERENCE TO RELATED APPLICATION

This application is a continuation-in-part patent application of U.S. application Ser. No. 16/253,377 having a filing date of Jan. 22, 2019, which claims priority to Taiwanese Application No. 107130805, having a filing date of Sep. 3, 2018, the entire contents both of which are hereby incorporated by reference for which priority is claimed under 35 U.S.C. § 120.

BACKGROUND OF THE INVENTION

1. Field of the Invention

The present disclosure relates to liquid transfer apparatus, and in particular to a liquid transfer apparatus using pressure difference.

2. Description of the Related Art

Liquid transfer apparatus is used to transfer liquid from one place to another, and is commonly found in factories or laboratories. Traditional liquid transfer apparatus uses valves to control the introduction of liquid. However, the liquid from the previous transfer may remain in the pipeline, especially in the valve. The valve may also be corroded and contaminate the liquid.

In some fields, there is a strict requirement that the liquid is not contaminated, such as a laboratory that tests the purity of chemicals. If the chemical sample for testing is contaminated by the liquid transfer apparatus, the testing is invalid.

Thus, it is desirable to have improvements liquid transfer apparatus.

BRIEF SUMMARY OF THE INVENTION

An objective of the present disclosure is to provide a liquid transfer apparatus, and in particular to a liquid transfer apparatus using pressure difference.

To achieve at least the above objective, the present disclosure provides a liquid transfer apparatus, comprising: an output terminal device, a receiving terminal device, a connecting pipeline, and a control device. The output terminal device includes a first storage container and a first pressurizing member, wherein the first storage container has a liquid injection opening and a liquid outlet, and the first pressurizing member is connected to the first storage container to fill the first storage container with high-pressure air. The receiving terminal device includes a second storage container and an air pressure adjusting member, wherein the second storage container has a liquid receiving inlet, the air pressure adjusting member is connected to the second storage container to adjust the air pressure inside the second storage container. The connecting pipeline connects the liquid outlet and the liquid receiving inlet. The control device is signally connected to the air pressure adjusting member. When the liquid transfer apparatus is in a non-transferring state, the control device adjusts the air pressure inside the second storage container through the air pressure adjusting member so that the air pressure inside the second storage container is high enough to prevent the liquid in the first storage container flow into the connecting pipeline. And when the liquid transfer apparatus is in a transferring state, the control device reduces the air pressure inside the second storage container through the air pressure adjusting member, so that the pressure difference between the inside of the first storage container and the inside of the second storage container is sufficient to drive the liquid in the first storage container to flow into the connecting pipeline and to enter the second storage container.

In an embodiment, the air pressure adjusting member includes a second pressurizing member and a pressure reducing member. The second pressurizing member is connected to the second storage container to fill the second storage container with high-pressure air. The pressure reducing member includes a pressure reducing chamber, a pressure reducing pipeline and a pressure reducing valve. The air pressure inside the pressure reducing chamber is lower than the air pressure inside the first storage container. The pressure reducing pipeline connects between the pressure reducing chamber and the second storage container. The pressure reducing valve is disposed at the pressure reducing pipeline, and the control device respectively signally connects the second pressurizing member and the pressure reducing valve.

In an embodiment, the air pressure inside the pressure reducing chamber is higher than one standard atmosphere.

In an embodiment, when the liquid transfer apparatus is in the transfer state, the pressure difference between the inside of the first storage container and the inside of the second storage container meets the following formula: $p>\rho gh$. Wherein "p" represents the pressure difference between the inside of the first storage container and the inside of the second storage container, "ρ" represents the density of the liquid, "g" represents the gravitational acceleration, and "h" represents the height difference between the highest point of the path of the connecting pipeline and the liquid outlet.

In an embodiment, the output terminal device further includes a drain member. The drain member includes a drain pipe and a drain pump. The drain pipe is connected to a drain outlet at the bottom of the first storage container, and the drain pump is disposed at the drain pipe and is signally connected to the control device.

In an embodiment, the output terminal device further includes a weighing member signally connected to the control device, and the control device determines whether to activate the drain pump according to the weight change of the first storage container measured by the weighing member.

In an embodiment, the output terminal device further includes a cleaning member disposed at the first storage container.

In an embodiment, a plurality of sets of the output terminal device and the connecting pipeline are respectively connected to the second storage container.

In an embodiment, a plurality of sets of the receiving terminal device and the connecting pipeline are respectively connected to the first storage container.

In an embodiment, the second storage container includes a fixed cover and a detachable bottle. The connecting pipeline and the air pressure adjusting member are connected to the fixed cover.

In an embodiment, the liquid transfer apparatus further includes a plurality of explosion-proof boxes. The output terminal device and the receiving terminal device are respectively disposed in the explosion-proof boxes.

In an embodiment, the connecting pipeline includes an inner tube and an outer tube. The liquid flows in the inner tube, and the outer tube covers the inner tube.

To achieve at least the above objective, the present disclosure provides a liquid transfer apparatus. the liquid transfer path of the liquid transfer apparatus of the present disclosure does not pass through any joints or valves, and the liquid will not be contaminated. The total volume of liquid transferring can be precisely controlled. In addition, the inside of the liquid transfer apparatus is full of high air pressure, so the vapor pressure of the liquid is very low and will not remain in the transfer path, and will not affect the next liquid transfer.

DETAILED DESCRIPTION OF THE INVENTION

To facilitate understanding of the object, characteristics and effects of this present disclosure, embodiments together with the attached drawings for the detailed description of the present disclosure are provided.

Figure 1A:
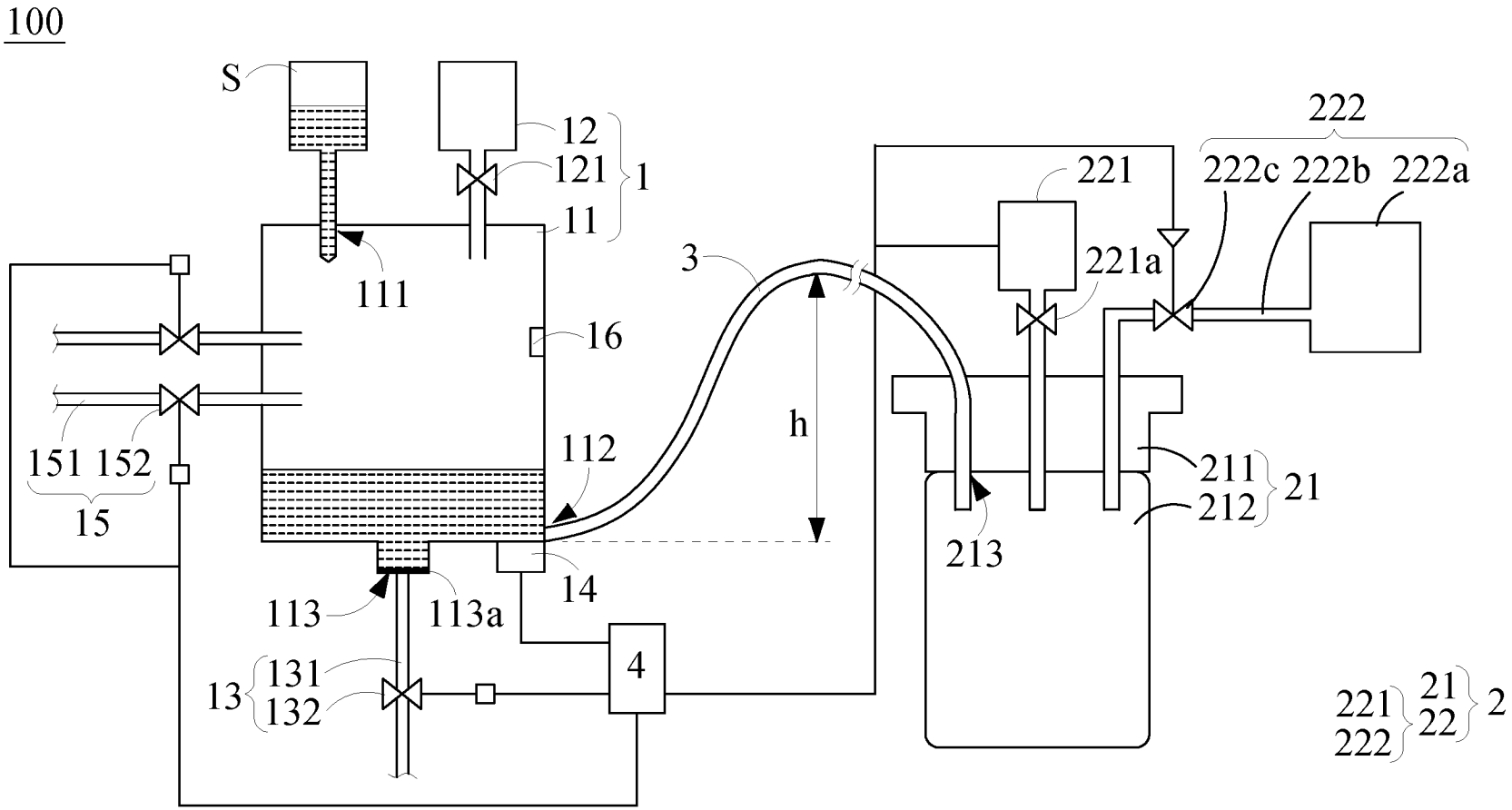
FIG. 1A is a schematic diagram illustrating a liquid transfer apparatus in a non-transferring state according to an embodiment of the present disclosure.

Referring to FIG. 1A, a liquid transfer apparatus 100 according to an embodiment of the present disclosure comprises an output terminal device 1, a receiving terminal device 2, a connecting pipeline 3, and a control device 4.

The output terminal device 1 includes a first storage container 11 and a first pressurizing member 12. The first storage container 11 has a liquid injection opening 111 and a liquid outlet 112. The liquid outlet 112 is preferably disposed near the bottom of the first storage container 11 to facilitate liquid transferring. The liquid injection opening 111 is preferably disposed at the top of the first storage container 11 or at least higher than the liquid outlet 112. However, the present application is not limited to this.

The first pressurizing member 12 is connected to the first storage container 11 to fill the first storage container 11 with high-pressure air. The first pressurizing member 12 is, for example, a high-pressure air source from a factory, a high-pressure air cylinder or a high-pressure air booster pump, for providing high-pressure nitrogen or inert gas. The first pressurizing member 12 optionally has a first unidirectional air inlet valve 121. When the air pressure inside the first storage container 11 is lower than a preset air pressure, the first unidirectional air inlet valve 121 is opened so that the first pressurizing member 12 injects high-pressure air into the first storage container 11. Preferably, the first pressurizing member 12 is normally connected to the first storage container 11 and keeps the air pressure inside the first storage container 11 at three standard atmospheres. However, the present application is not limited to this. The value of the air pressure inside the first storage container 11 may be other values, and the first pressurizing member 12 may be configured to be connected to the first storage container 11 when pressurization is required.

The receiving terminal device 2 includes a second storage container 21 and an air pressure adjusting member 22. The second storage container 21 has a liquid receiving inlet 213. The air pressure adjusting member 22 is connected to the second storage container 21 to adjust the air pressure inside the second storage container 21.

In this embodiment, the air pressure adjusting member 22 includes a second pressurizing member 221 and a pressure reducing member 222. The second pressurizing member 221 is connected to the second storage container 21 to fill the second storage container 21 with high-pressure air. The second pressurizing member 221 may have a second unidirectional inlet valve 221*a*. The structure and principle of the second pressurizing member 221 are the same as those of the first pressurizing member 12, and will not be described again.

The pressure reducing member 222 includes a pressure reducing chamber 222*a*, a pressure reducing pipeline 222*b*, and a pressure reducing valve 222*c*. The air pressure inside the pressure reduction chamber 222*a* is lower than the air pressure inside the first storage container 11 and the air pressure of the second pressurizing member 221, and is preferably higher than one standard atmosphere (two standard atmospheres in this embodiment). The pressure reducing pipeline 222*b* connects between the pressure reducing chamber 222*a* and the second storage container 21. The pressure reducing valve 222*c* is disposed at the pressure reducing pipeline 222*b*.

When the second pressurizing member 221 and the second storage container 21 are unblocked, the second pressurizing member 221 injects high-pressure air into the second storage container 21 to increase the air pressure inside the second storage container 21. When the second pressurizing member 221 and the second storage container 21 are blocked, and the pressure reduction chamber 222*a* and the second storage container 21 are unblocked through the pressure reduction pipeline 222*b*, the high pressure air in the second storage container 21 flows to the pressure reduction chamber 222*a*, so that the air pressure inside the second storage container 21 is reduced.

However, the present application is not limited to this. In other embodiments, the air pressure adjusting member 22 may adjust the air pressure inside the second storage container 21 in other ways.

The connecting pipeline 3 connects the liquid outlet 112 and the liquid receiving inlet 213 to transferring the liquid in the first storage container 11 to the second storage container 21.

The control device 4 is signally connected to the air pressure adjusting member 22. The control device 4 adjusts the air pressure inside the second storage container 21 through the air pressure adjusting member 22. The control device 4 is, for example, a control chip or a control circuit. In this embodiment, the control device 4 is signally connected to the second pressurizing member 221 and the pressure reducing valve 222*c* respectively.

The liquid transfer apparatus 100 will be described below about how to transfer liquid.

As shown in FIG. 1A, an external feeding device S injects liquid into the first storage container 11 through the liquid injection opening 111. Since the first storage container 11 may normally maintain a high air pressure, the feeding device S can inject liquid into the first storage container 11 through a needle or other pressurized feeding methods. The feeding device S may be a device fixed at the liquid injection opening 111 or a detachable device. The first pressurizing member 12 can inject high-pressure air into the first storage container 11 before or after the feeding, so that inside of the first storage container 11 is maintained at three standard atmospheres. An air pressure sensor 16 can sense the air pressure inside the first storage container 11 to determine whether to activate the first pressurizing member 12. The activation of the first pressing member 12 may be manual operation or automatic operation by the control device 4.

When the liquid is injected into the first storage container 11, the liquid pressure on the surface of the liquid and the air pressure inside the first storage container 11 reach a balance, that is, three standard atmospheres. The pressure at the bottom of the liquid is three atmospheric pressures plus the pressure generated by the height of the liquid (the product of the density of the liquid, the gravitational acceleration and the height of the liquid). However, in this embodiment, the liquid surface only needs to reach the height of the liquid outlet 112. Therefore, the additional pressure generated by the height of the liquid is very small and can be ignored. Therefore, the liquid pressure is approximately equal to three standard atmospheres.

As shown in FIG. 1A, when the liquid transfer apparatus 100 is in a non-transferring state, the control device 4 adjusts the pressure inside the second storage container 21 through the air pressure adjusting member 22 (the second pressing member 221 in this embodiment,) in order to prevent the liquid from entering the second storage container 21 through the connecting pipeline 3. The pressure inside the second storage container 21 must not be less than the pressure inside the first storage container 11. And preferably, the connecting pipeline 3 has at least one upward path (relative to the height of the liquid outlet 112), or the pressure inside the second storage container 21 is higher than the pressure inside the first storage container 11, so as to effectively prevent the liquid from flowing into the second storage container 21 unexpectedly.

Further, in order to make the liquid stay in the first storage container 11 and do not flowing into the connecting pipeline 3, the pressure inside the second storage container 21 is preferably slightly higher than the pressure inside the first storage container 11, or the path of the connecting pipeline 3 directly rises from the liquid outlet 112. The details of pressure control and path height will be further discussed later.

Figure 1B:
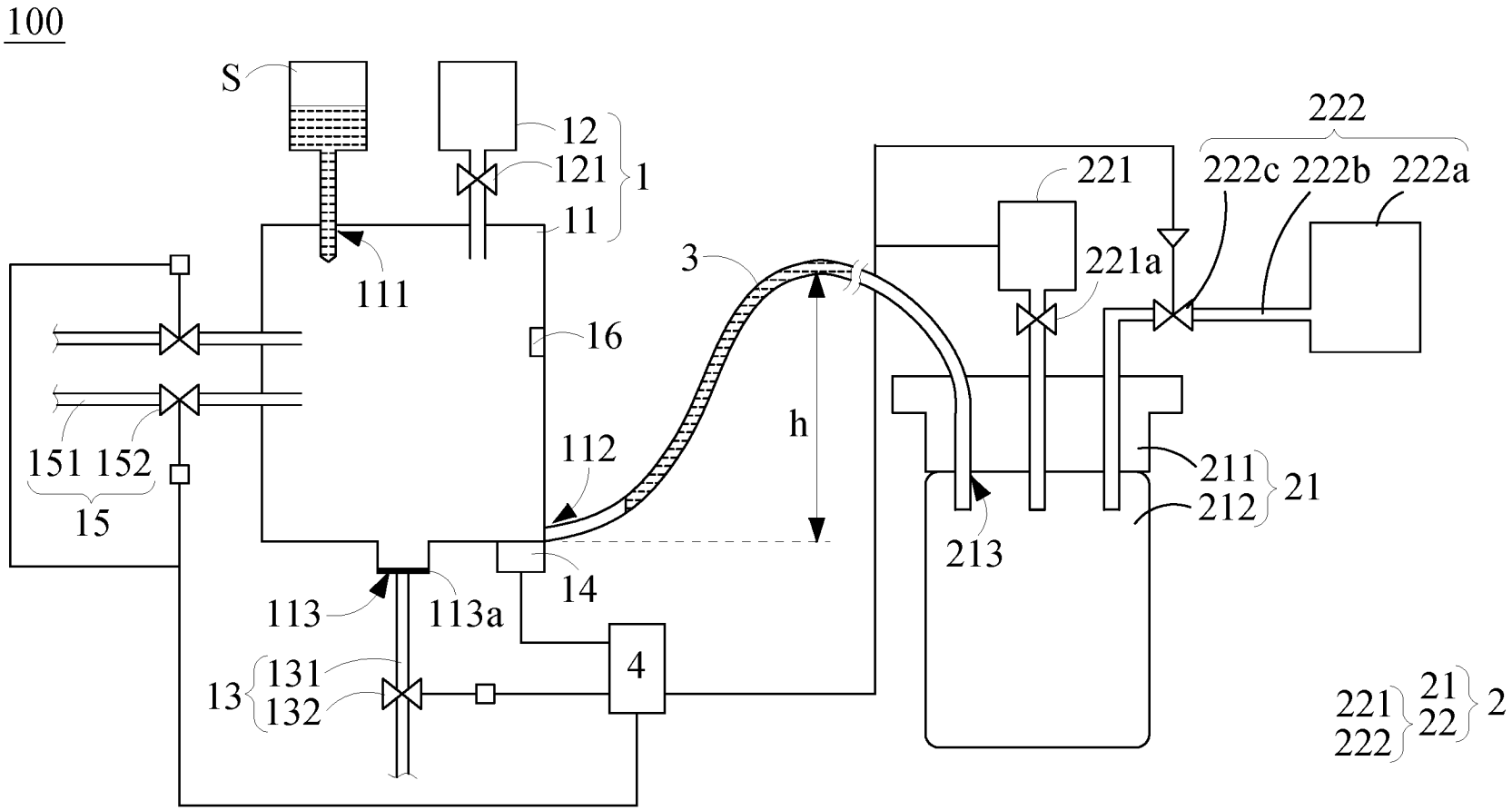
FIG. 1B is a schematic diagram illustrating the liquid transfer apparatus which is transferring liquid according to an embodiment of the present disclosure.
Figure 1C:
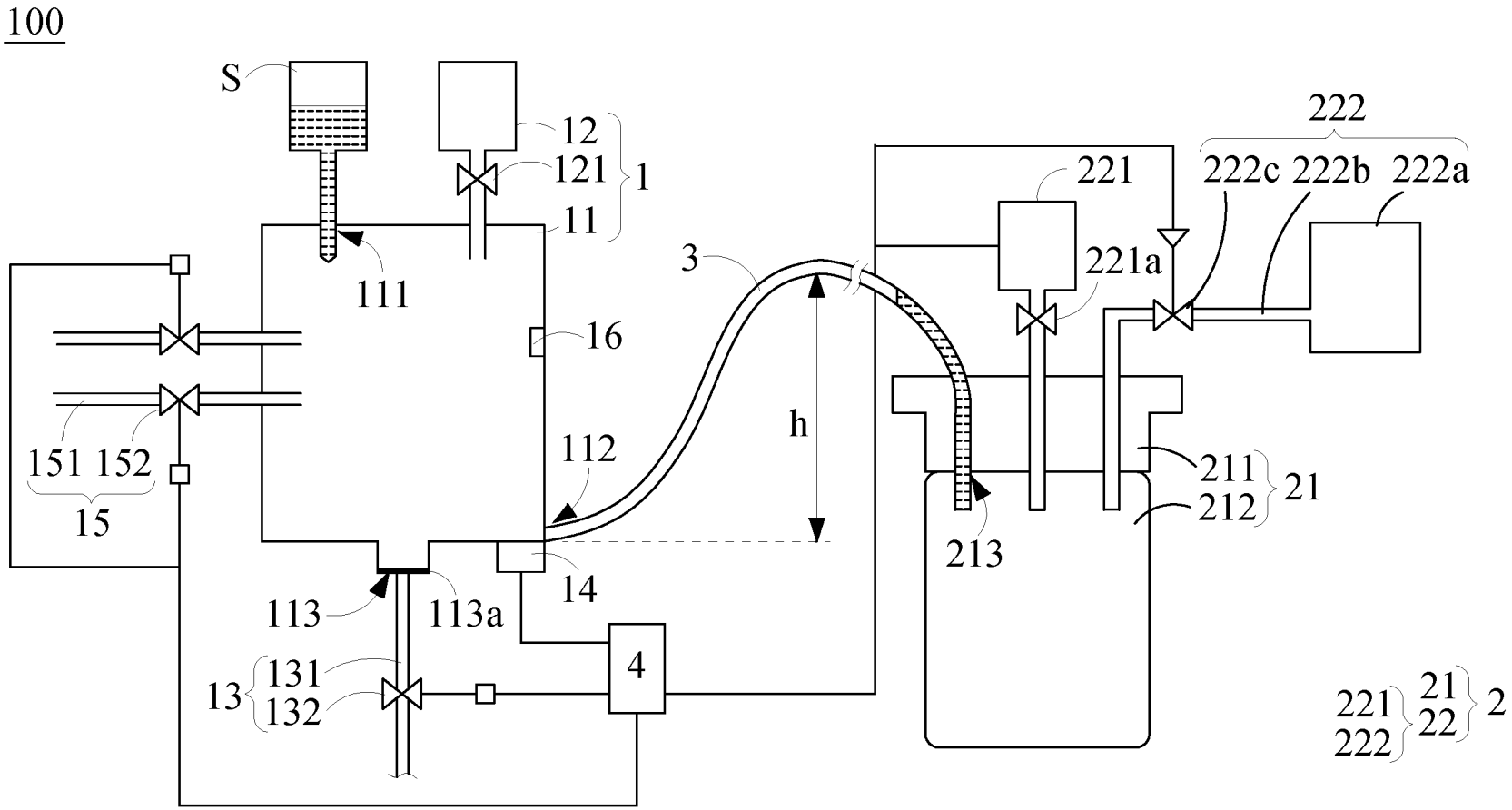
FIG. 1C is a schematic diagram illustrating liquid entering the second storage container according to an embodiment of the present disclosure.

As shown in FIGS. 1B and 1C, when the liquid transfer apparatus 100 is in a transferring state, the control device 4 reduces the air pressure inside the second storage container 21 through the air pressure adjusting member 22 (the pressure reducing member 222 in this embodiment), so that the pressure difference between the inside of the first storage container 11 and the inside of the second storage container 21 is sufficient to drive the liquid in the first storage container 11 to flow into the connecting pipeline 3 (as shown in FIG. 1B) and to enter the second storage container 21 (as shown in FIG. 1C).

In this embodiment, the liquid transfer apparatus 100 is mainly used for a sampling and testing system provided to a laboratory, so the volume of liquid injected by the feeding device S each time is not more than the total volume inside the connecting pipeline 3. That is, the connecting pipeline 3 will not be completely filled with the liquid when the liquid is transferred. However, the present application is not limited to this. The liquid transfer apparatus 100 can be used in other systems that need to transfer liquid, and the liquid transfer apparatus 100 can transfer more volume of liquid at a time.

When the control device 4 reduces the air pressure inside the second storage container 21 through the air pressure adjusting member 22, there is an air pressure difference between the inside of the second storage container 21 and the inside of the first storage container 11. This air pressure difference pushes the liquid into the second storage container 21. In a better example, the control device 4 can gradually reduce the air pressure inside the second storage container 21 by opening the pressure reducing valve 222*c* slowly and gradually For example, at 0-5 seconds, the air pressure inside the second storage container 21 is 2.9 standard atmospheres, and after 5 seconds, it drops to 2.8 standard atmospheres, and so on. This method is to prevent the liquid from flowing too fast and creating bubbles.

Figure 6:
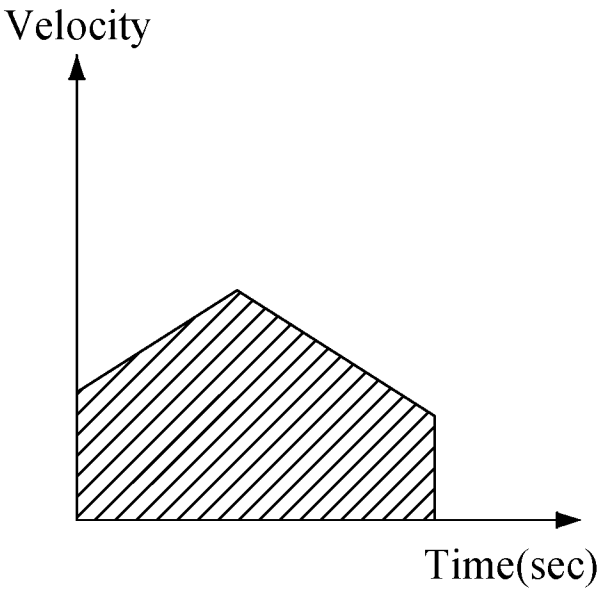
FIG. 6 is a schematic diagram of calculating liquid flow.

According to Newton's second law: F=ma, it is known that the applied force is proportional to the acceleration of an object. The cross-sectional area of the connecting pipeline 3 is fixed, so the pressure difference is proportional to the generated force and also proportional to the acceleration of the liquid movement. In other words, the acceleration caused by the pressure difference is calculable. The flow velocity of the liquid is a function of the acceleration of the liquid movement and time. When the pressure difference is gradually changed, the flow velocity of the liquid will also change accordingly. As shown in FIG. 6, the total volume of liquid entering the second storage container 21 can be accurately calculated by calculating the integral of the liquid flow velocity and time multiplied by the cross-sectional area of the connecting pipeline 3.

In summary, the liquid transfer path of the liquid transfer apparatus 100 of the present application does not pass through any joints or valves, and the liquid will not be contaminated. The total volume of liquid transferring can be precisely controlled. In addition, the inside of the liquid transfer apparatus 100 is full of high air pressure, so the vapor pressure of the liquid is very low and will not remain in the transfer path, and will not affect the next liquid transfer.

Further, when the liquid transfer apparatus 100 is in the transfer state, the pressure difference between the inside of the first storage container 11 and the inside of the second storage container 21 meets the following formula: $p>\rho gh$. Here "p" represents the pressure difference between the inside of the first storage container 11 and the inside of the second storage container 21, "ρ" represents the density of the liquid, "g" represents the gravitational acceleration, and "h" represents the height difference between the highest point of the path of the connecting pipeline 3 and the liquid outlet 112.

Figure 7A:
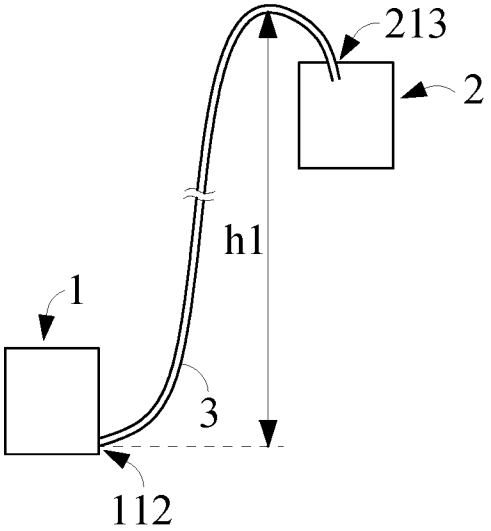
FIG. 7A is a schematic diagram illustrating the position of the liquid receiving inlet being higher than the position of the liquid outlet according to an embodiment of the present disclosure.

As shown in FIG. 7A, the height of the liquid receiving inlet 213 is higher than the height of the liquid outlet 112. This means that the connecting pipeline 3 must have at least one upward path. In FIG. 7A, the height difference between the highest point of the path of the connecting pipeline 3 and the liquid outlet 112 is expressed as h1. This means that even if the liquid transfer apparatus 100 is in the non-transferring state, as long as the pressure difference between the inside of the second storage container 21 and the inside of the first storage container 11 is less than ρgh1, the liquid cannot enter the second storage container 21 through the connecting pipeline 3. Therefore, the air pressure inside the second storage container 21 can be kept slightly lower than the air pressure inside the first storage container 11 in a normal state. As long as the air pressure inside the second storage container 21 is kept equal to or slightly higher than the air pressure inside the first storage container 11 in a normal state, the liquid can be restricted in the first storage container 11 and does not enter the connecting pipeline 3. On the other hand, when the liquid transfer apparatus 100 is in the transferring state, the air pressure difference between the inside of the second storage container 21 and the inside of the first storage container 11 must be higher than ρgh1 (the air pressure inside the second storage container 21 is lower than the air pressure inside the first storage container 11) to overcome the influence of the height difference.

Figure 7C:
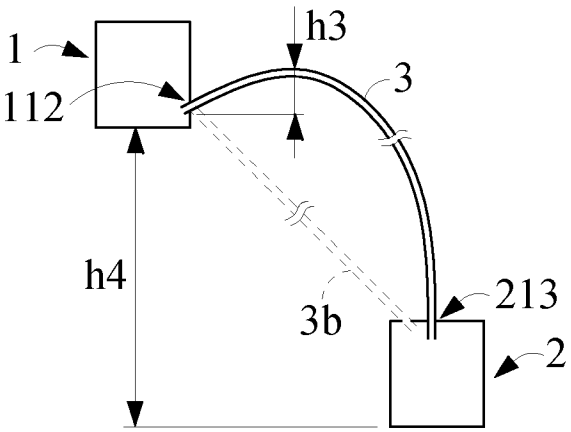
FIG. 7C is a schematic diagram illustrating the position of the liquid receiving inlet being lower than the position of the liquid outlet according to an embodiment of the present disclosure.
Figure 7B:
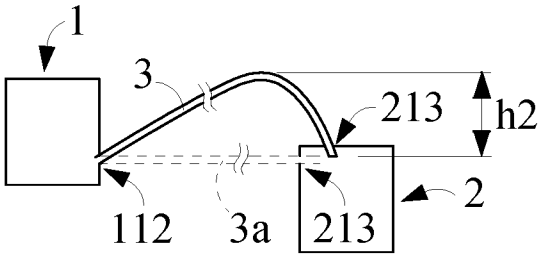
FIG. 7B is a schematic diagram illustrating the position of the liquid receiving inlet equal to the position of the liquid outlet according to an embodiment of the present disclosure.

As shown in FIG. 7B, the height of the liquid receiving inlet 213 is approximately equal to the height of the liquid output outlet 112. In FIG. 7B, if the connecting pipeline 3 does not have at least one upward path (for example, as shown by the dashed connecting pipeline 3*a*) and the liquid transfer apparatus 100 is in the non-transferring state, the air pressure inside the second storage container 21 must be higher than the air pressure inside the first storage container 11 for prevent the liquid in the first storage container 11 from flowing into the second storage container 21. However, when the liquid transfer apparatus 100 is in the transferring state, only a slight pressure difference can drive the liquid into the second storage container 21 via the dashed connecting pipeline 3*a*. If the connecting pipeline 3 has at least one upward path, the height difference between the highest point of the path of the connecting pipeline 3 and the liquid outlet 112 in FIG. 7B is expressed as h2. When the liquid transfer apparatus 100 is in the non-transferring state, as long as the pressure difference between the inside of the second storage container 21 and the inside of the first storage container 11 is less than ρgh2, the liquid cannot enter the second storage container 21 through the connecting pipeline 3. Therefore, the air pressure inside of the second storage container 21 can be kept slightly lower than the air pressure inside the first storage container 11 in a normal state. As long as the air pressure inside the second storage container 21 is normally maintained equal to or slightly higher than the air pressure inside the first storage container 11 in a normal state, the liquid can be restricted in the first storage container 11 and does not enter the connecting pipeline 3. On the other hand, when the liquid transfer apparatus 100 is in the transferring state, the air pressure difference between the inside of the second storage container 21 and the inside of the first storage container 11 must be higher than ρgh2 (the air pressure inside the second storage container 21 is lower than the air pressure inside the first storage container 11) to overcome the influence of the height difference.

As shown in FIG. 7C, the height of the liquid receiving inlet 213 is lower than the height of the liquid outlet 112, and the height difference between the two is expressed as h4. In FIG. 7C, if the connecting pipeline 3 does not have at least one upward path (for example, as shown by the dashed connecting pipeline 3*b*) and the liquid transfer apparatus 100 is in the non-transferring state, the air pressure difference between the inside of the second storage container 21 and the inside of the first storage container 11 must be larger than ρgh4 (the air pressure inside the second storage container 21 is higher than the air pressure inside the first storage container 11) for preventing the liquid inside the first storage container 11 from flowing into the second storage container 21. Conversely, when the liquid transfer apparatus 100 is in the transferring state, as long as the air pressure difference between the inside of the second storage container 21 and the inside of the first storage container 11 is lower than ρgh4, the liquid inside the first storage container 11 can easily flow into the second storage container 21. If the connecting pipe 3 has at least one upward path, the height difference between the highest point of the path of the connecting pipeline 3 and the liquid outlet 112 in FIG. 7C is expressed as h3. The method of pressure control is the same as the example described in FIG. 7B, and will not be repeated.

In summary, the liquid transfer apparatus 100 of the present application can determine the more suitable air pressure control for the second storage container 21 according to the relative height of the liquid receiving inlet 213 and the liquid outlet 112 in conjunction with the path design of the connecting pipeline 3.

Figure 1D:
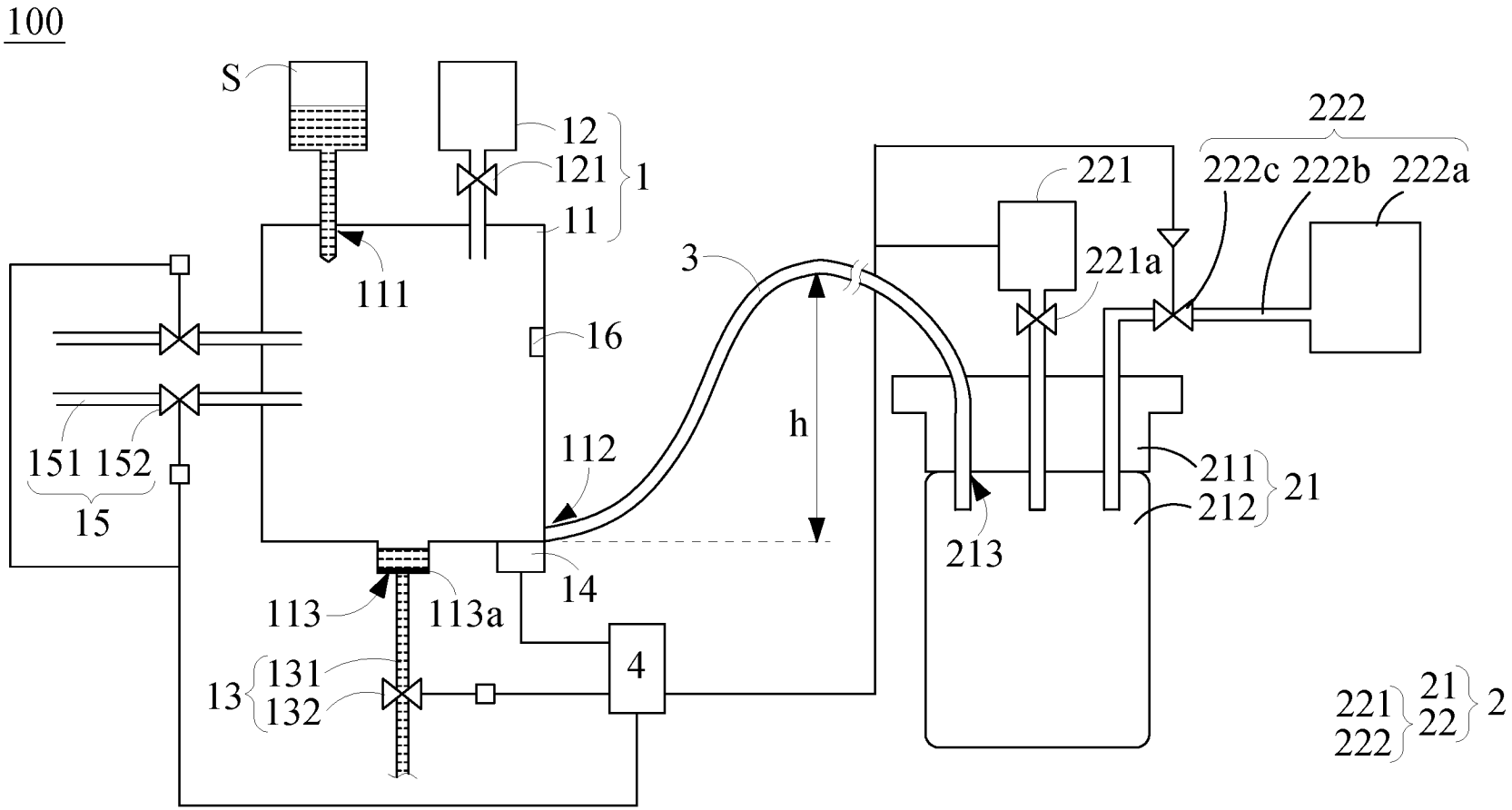
FIG. 1D is a schematic diagram illustrating the output terminal device performing draining according to an embodiment of the present disclosure.

Furthermore, as shown in FIGS. 1A and 1D, the output terminal device 1 further includes a drain member 13. The drain member 13 includes a drain pipe 131 and a drain pump 132. The drain pipe 131 is connected to a drain outlet 113 at the bottom of the first storage container 11. The drain pump 132 is disposed at the drain pipe 131. The remaining liquid in the first storage container 11 can be drained through the drain member 13. In a preferred embodiment, the drain outlet 113 is provided with a unidirectional sealing film 113*a*. The unidirectional sealing membrane 113*a* is opened when the pressure difference between the two sides of the unidirectional sealing membrane 113*a* is larger than a certain degree, so that the liquid enters the drain pipe 131 through the drain outlet 113. As shown in FIG. 1A, the drain pump 132 is not activated, and there is no pressure difference between the two sides of the unidirectional sealing membrane 113*a*. As shown in FIG. 1D, the drain pump 132 is activated and exhaust air for reducing the air pressure of the drain pipe 131, so the unidirectional sealing film 113*a* is opened to allow the liquid to enter the drain pipe 131 through the drain outlet 113. The drain pump 132 can be manually operated, or it can be signally connected to the control device 4, and the drain pump 132 is commanded to be activated via the control device 4. In other embodiments, the drain member 13 does not have a drain pump 132. The pressurizing member 12 and/or the second pressurizing member 221 are manually operated or commanded by the control device 4 to pressurize the first storage container 11 for forcing the remaining liquid to enter the drain pipe 131 through the unidirectional sealing film 113*a*.

Furthermore, the output terminal 1 further includes a weighing member 14 signally connected to the control device 4. The control device 4 determines whether to activate the drain pump 132 according to the weight change of the first storage container 11 measured by the weighing member 14.

Furthermore, the output terminal device 1 further includes a cleaning member 15 disposed at the first storage container 11. The cleaning component 15 includes a cleaning pipe 151 and a cleaning valve 152. The cleaning pipe 151 can introduce water, cleaning liquid or other rinsing liquids into the first storage container 11. The introduced liquid is discharged by the liquid drain member 13. The cleaning valve 152 is disposed at the cleaning pipe 151 to control the entry of introduced liquid. The cleaning valve 152 can be manually operated, or it can be signally connected to the control device 4, and the cleaning valves 152 is commanded to activate via the control device 4. The cleaning member 15 may have multiple sets of cleaning pipes 151 and cleaning valves 152, which respectively introduce different water, cleaning liquids or other rinsing liquids.

Furthermore, as shown in FIG. 1A, the second storage container 21 includes a fixed cover 211 and a detachable bottle 212. The connecting pipeline 3 and the air pressure adjusting member 22 (including the second pressurizing member 221 and the pressure reducing pipeline 222*b*) are connected to the fixed cover 211. The detachable bottle body 212 can be separated from the fixed cover body 211 to easily take out the liquid. However, in other embodiments, the second storage container 21 is provided with a suction tube for introducing the liquid in the second storage container 21.

Figure 2:
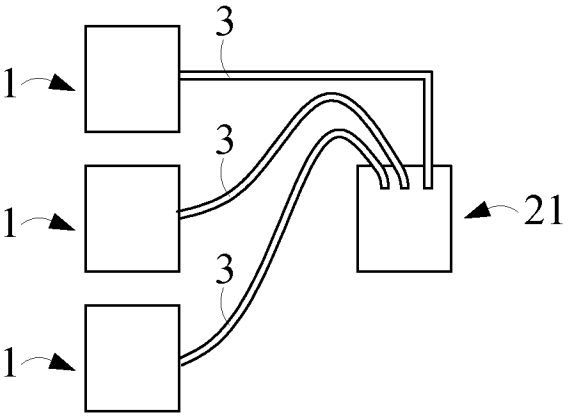
FIG. 2 is a schematic diagram illustrating a plurality of sets of the output terminal device and the connecting pipeline according to an embodiment of the present disclosure.

As shown in FIG. 2, in one embodiment, a plurality of sets of output terminal devices 1 and connecting pipelines 3 are respectively connected to the second storage container 21. A plurality of sets of output terminal devices 1 and connecting pipelines 3 respectively transfer different liquids received by the same second storage container 21.

Figure 3:
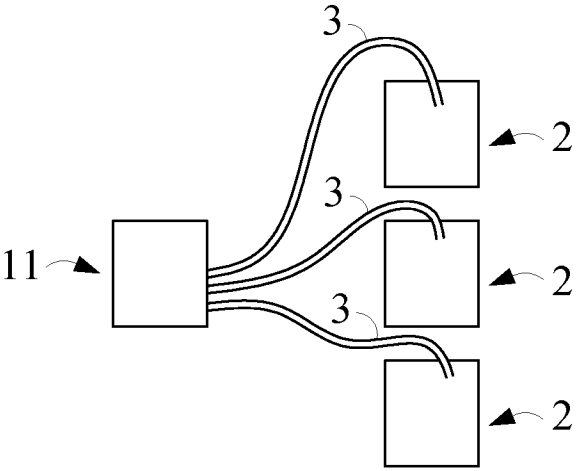
FIG. 3 is a schematic diagram illustrating a plurality of sets of the receiving terminal device and the connecting pipeline according to an embodiment of the present disclosure.

As shown in FIG. 3, in one embodiment, a plurality of sets of receiving terminal devices 2 and connecting pipelines 3 are respectively connected to the first storage container 11. The liquid in the same first storage container 11 can be transferred to different second storage containers 21 respectively.

Figure 4:
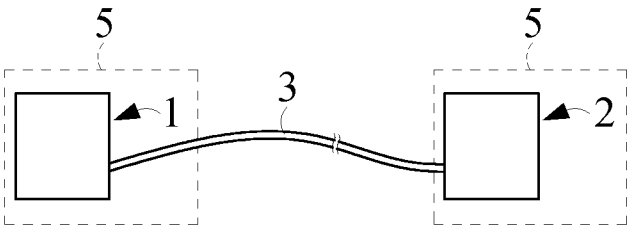
FIG. 4 is a schematic diagram illustrating explosion-proof boxes according to an embodiment of the present disclosure.

As shown in FIG. 4, in one embodiment, the liquid transfer apparatus 100 further includes a plurality of explosion-proof boxes 5. The output terminal device 1 and the receiving terminal device 2 are respectively disposed in these explosion-proof boxes 5. The explosion-proof box 5 is used to provide safety protection.

Figure 5:
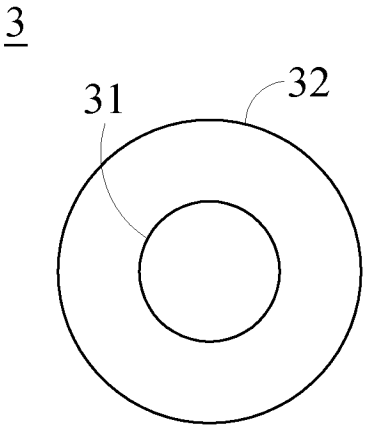
FIG. 5 is a cross-sectional view of a connecting pipeline according to an embodiment of the present disclosure.

As shown in FIG. 5, in one embodiment, the connecting pipeline 3 includes an inner tube 31 and an outer tube 32. The liquid flows in the inner tube 31, and the outer tube 32 covers the inner tube 31. The outer tube 32 can prevent the liquid inside the inner tube 31 from leaking to the outside of the liquid transfer apparatus 100.

While the present disclosure has been described by means of specific embodiments, numerous modifications and variations could be made thereto by those skilled in the art without departing from the scope and spirit of the present disclosure set forth in the claims.

What is claimed is:

1. A liquid transfer apparatus, comprising:

an output terminal device including a first storage container and a first pressurizing member, wherein the first storage container has a liquid injection opening and a liquid outlet, and the first pressurizing member is connected to the first storage container to fill the first storage container with high-pressure air;

a receiving terminal device including a second storage container and an air pressure adjusting member, wherein the second storage container has a liquid receiving inlet, the air pressure adjusting member is connected to the second storage container to adjust the air pressure inside the second storage container;

a connecting pipeline connecting the liquid outlet and the liquid receiving inlet; and a control device signally connected to the air pressure adjusting member, wherein when the liquid transfer apparatus is in a non-transferring state, the control device adjusts the air pressure inside the second storage container through the air pressure adjusting member so that the air pressure inside the second storage container is high enough to prevent the liquid in the first storage container from flowing into the connecting pipeline, and when the liquid transfer apparatus is in a transferring state, the control device reduces the air pressure inside the second storage container through the air pressure adjusting member, so that the pressure difference between the inside of the first storage container and the inside of the second storage container is sufficient to drive the liquid in the first storage container to flow into the connecting pipeline and to enter the second storage container;

wherein the output terminal device further includes a drain member, the drain member includes a drain pipe and a drain pump, the drain pipe is connected to a drain outlet at the bottom of the first storage container, and the drain pump is disposed at the drain pipe and is signally connected to the control device.

2. The liquid transfer apparatus according to claim 1, wherein the air pressure adjusting member includes a second pressurizing member and a pressure reducing member, the second pressurizing member is connected to the second storage container to fill the second storage container with high-pressure air, the pressure reducing member includes a pressure reducing chamber, a pressure reducing pipeline and a pressure reducing valve, the air pressure inside the pressure reducing chamber is lower than the air pressure inside the first storage container, the pressure reducing pipeline connects between the pressure reducing chamber and the second storage container, the pressure reducing valve is disposed at the pressure reducing pipeline, and the control device respectively signally connects the second pressurizing member and the pressure reducing valve.

3. The liquid transfer apparatus according to claim 2, wherein the air pressure inside the pressure reducing chamber is higher than one standard atmosphere.

4. The liquid transfer apparatus according to claim 1, wherein when the liquid transfer apparatus is in the transfer state, the pressure difference between the inside of the first storage container and the inside of the second storage container meets the following formula: $p>\rho gh$, wherein "p" represents the pressure difference between the inside of the first storage container and the inside of the second storage container, "ρ" represents the density of the liquid, "g" represents the gravitational acceleration, and "h" represents the height difference between the highest point of the path of the connecting pipeline and the liquid outlet.

5. The liquid transfer apparatus according to claim 1, wherein the output terminal device further includes a weighing member signally connected to the control device, and the control device determines whether to activate the drain pump according to the weight change of the first storage container measured by the weighing member.

6. The liquid transfer apparatus according to claim 1, wherein the output terminal device further includes a cleaning member disposed at the first storage container.

7. The liquid transfer apparatus according to claim 1, further including a plurality of sets of the output terminal device and the connecting pipeline respectively connected to the second storage container.

8. The liquid transfer apparatus according to claim 1, further including a plurality of sets of the receiving terminal device and the connecting pipeline respectively connected to the first storage container.

9. The liquid transfer apparatus according to claim 1, wherein the second storage container includes a fixed cover and a detachable bottle, the connecting pipeline and the air pressure adjusting member are connected to the fixed cover.

10. The liquid transfer apparatus according to claim 1, further including a plurality of explosion-proof boxes, wherein the output terminal device and the receiving terminal device are respectively disposed in the explosion-proof boxes.

11. The liquid transfer apparatus according to claim 1, wherein the connecting pipeline includes an inner tube and an outer tube, the liquid flows in the inner tube, and the outer tube covers the inner tube.

* * * * *